United States Patent [19]

Pereira et al.

[11] Patent Number: 4,664,288

[45] Date of Patent: May 12, 1987

[54] PRESSURE VENTING CLOSURE CAP FOR A CONTAINER SPOUT

[75] Inventors: Joseph J. Pereira; Anthony D. Delia, both of West Redding; Scott W. Miller, Milford, all of Conn.

[73] Assignee: Clairol Incorporated, New York, N.Y.

[21] Appl. No.: 856,545

[22] Filed: Apr. 28, 1986

[51] Int. Cl.[4] ..... B65D 51/16

[52] U.S. Cl. ..... 220/209; 220/270; 220/306; 215/207; 222/541; 222/525

[58] Field of Search ..... 220/207, 209, 270, 306, 220/203; 215/250, 307, 320, 329, 321; 222/541, 566, 522, 525

[56] References Cited

U.S. PATENT DOCUMENTS 2,884,151 4/1959 Biederman ..... 215/307

3,179,276 4/1965 Safianoff ..... 215/307

*Primary Examiner*—George T. Hall

*Attorney, Agent, or Firm*—G. Warzecha

[57] ABSTRACT

A manually openable closure system for a container spout. The closure is provided with a pull tab extending below the closure and adjacent the spout surface. The closure is removable from the spout without the use of any auxiliary cutting or other tools. The closure is resilient and is provided with a top portion for sealing the spout orifice and for venting the interior of the container by being deformed by an excessive internal pressure to uncover the orifice thereby venting the interior of the container via the space between the cap and the spout.

10 Claims, 8 Drawing Figures

PRESSURE VENTING CLOSURE CAP FOR A CONTAINER SPOUT

BACKGROUND OF THE INVENTION

1. FIELD of the INVENTION

The invention relates to closure devices for sealing containers. More particularly, the invention relates to closure devices for sealing container spouts while providing a means to relieve any excessive pressure which may exist in the container.

2. DESCRIPTION of the PRIOR ART

Containers provided with spouts have an obvious utility to consumers as, among other things, product applicators for directing the container contents in a concentrated stream to a predetermined point. If a container intended for use with a spout is already filled with product prior to purchase by a consumer, the container must be sealed to prevent spillage during shipment and prior to use.

One method of shipping such a filled container having contents intended for use with a container spout is to use a conventional, threaded closure cap sealing the container during shipment and an auxiliary spout packaged with the sealed container. A consumer could alternate the cap and spout as desired. This method obviously requires an extra part to be manufactured for use of the container contents and is, therefore, costly. It would be preferable to ship and sell to consumers a container with a spout already threaded on the container so that no separate closure cap is necessary. Where spout orifice size is not critical, such containers are provided with sealed spout tips which must be cut off prior to use. However, this conventional method is incapable of venting excessive pressures in the container while sealing the container.

If a product is capable of generating excessive internal pressures within a container, the product is shipped and sold with its component parts separated. A consumer must mix the parts prior to use. Certain products such as hair coloring products are generally packaged for consumers in the form of a container of hydrogen peroxide or other peroxide based developer sealed with a conventional threaded tapered spout and a separate package of dyestuff. The consumer can remove the sealed threaded spout and mix the dyestuff and developer in the container to prepare the hair dye. To use the product, the consumer must snip the tip of the sealed spout to create an orifice of desired size and also to vent the pressure created within the container by the dyestuff/developer mixture.

This type of container and spout combination has several deficiencies: the spout tip must be cut off with an auxiliary cutting tool which must be supplied by the consumer; the size of the orifice created by various consumers may not be uniform, thus creating the opportunity for the product to be improperly used; the cutting process may create a sharp edge at the tip and this presents a danger of irritation to the consumer's scalp during use; if a consumer inadvertently replaces the spout cap after mixing the components without snipping the tip, the internal pressure in the container builds to a dangerous level creating the possibility of explosion because there is no pressure venting means. To enhance consumer convenience and safety, a spout closure is needed which may be manually opened, without auxiliary tools, to provide a uniform, smooth orifice and which is capable of venting excessive internal pressure. The spout closure should be capable of being placed on a spout after the spout is opened in order to provide at least a partial closure to limit or prevent spillage.

Several types of container closures are known in the prior art. Examples of those which are suitable for sealing container spouts are, however, limited. U.S. Pat. No. 2,887,240 discloses a tapered spout, the tip of which is sealed during shipment and intended to be cut by the consumer prior to use. A separate cap is provided which may thereafter be used to enclose the orifice of the cut spout. The closure shown in this patent does not overcome the deficiencies cited above.

U.S. Pat. No. 3,253,728 shows a cylindrical, non-tapered, extensible spout provided with a manually removable closure cap. The cap is provided with an annular bead along its bottom rim for engaging an annular groove in the spout tip. There is no means shown for easily removing the closure cap other than forcibly deforming it to disengage the annular rib from the groove. Also, there is no means in this device for venting any excessive pressure built up within the container.

U.S. Pat. No. 2,886,198 discloses a closure cap for a bottle orifice which closure may be adapted to a spout. The closure in this patent is constructed of a resilient material and is provided with a pull lug extending from the cap and connected to the bottom portion of the closure which covers the orifice of the container. A thinned portion of the closure facilitates the tearing away of the pull lug and closure portion connected to it. The pull lug of this closure extends obtrusively from the closure and is therefore likely to be accidentally pulled or torn, thus opening the closure prematurely. Also, there is no means provided with this closure for venting any excessive pressure built up in the container.

U.S. Pat. No. 1,134,068 shows a closure for an outwardly tapered jar. The closure is provided with a pull tab generally aligned with the external surface of the jar. While this pull tab is not obtrusive, the closure itself is made of metal and is intended to be deformed by pulling the pull tab, thus removing the closure. Since the closure is assembled with the use of machinery required to deform an annular rim of the closure, a consumer would be unable to reseal the container effectively. Also, there is no means shown in this patent for relieving any internal pressure built up in the container.

In view of the above, it is an object of this invention to provide a manually removable closure cap for a container spout. It is a further object of this invention to provide a closure for a container spout which closure may be easily removed by a consumer without the necessity for any cutting or other implements.

It is yet another object of this invention to provide a manually removable closure cap for a container spout which closure cap effectively seals the container contents prior to being opened by a consumer and which permits venting of any excessive pressure built up in the container.

SUMMARY OF THE INVENTION

These and other objects of this invention are provided by a closure system for a container spout comprising a spout having an annular bead on the external surface of the spout adjacent the orifice, a cup shaped cap provided with an inwardly extending annular bead adjacent its rim, and a pull tab which extends generally along the external surface of the spout below the cap. The cap is provided with thinned portions on either side of the pull tab to facilitate tearing of these portions and removal of the cap. The top of the cap is provided with a hemispherical bead for sealing the spout orifice. The top is sufficiently resilient to enable the bead to be forced away from the orifice by excessive internal pressures within the container thereby permitting the venting of the container.

DESCRIPTION OF THE PREFERRED EMBODIMENT

Figures 1, 2, 3, 3A, 4, 5, 6, 7:
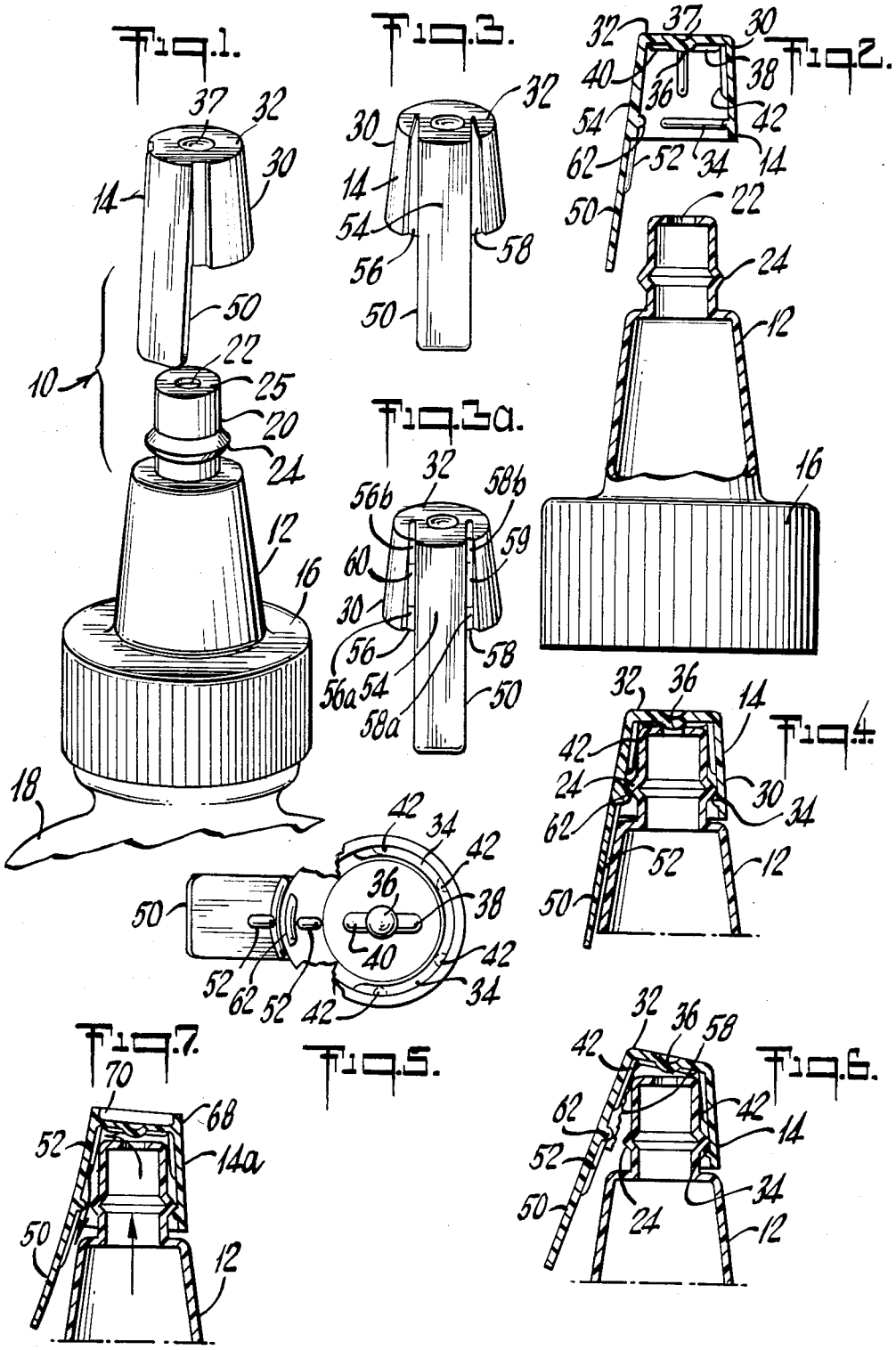
FIG. 1 is a perspective view of the individual components of a spout closure system constructed in accordance with the invention.
FIG. 2 is a cross-sectional side elevation view of the closure cap and spout shown in FIG. 1 with the pull tab in the closed position.
FIGS. 3 and 3*a* are front perspective views of alternate embodiments of the closure cap shown in FIG. 1.
FIG. 4 is a cross-sectional elevation view of the assembled parts of FIG. 2 shown in sealing engagement.
FIG. 5 is a bottom plan view of the closure cap shown in FIG. 2 with the pull tab in the opened position.
FIG. 6 is a cross-sectional elevation view of the closure system during the opening process.
FIG. 7 is a cross-sectional elevation view of an assembly utilizing an alternate embodiment of the closure cap showing also the pressure venting feature of the assembly.

Referring now to FIG. 1, there is shown a closure system 10 comprising a spout 12 and a closure cap 14. Spout 12 is threaded at end 16 for threadable engagement on container 18. The other end 20 of spout 12 is provided with a concentrically situated orifice 22 and an annular radially outwardly extending bead 24. Bead 24 is parallel to the rim 2 surrounding orifice 22 and is situated a predetermined distance below the rim.

Cap 14 is a cup-shaped structure, best seen in FIGS. 1, 2, and 5 having a substantially cylindrical side wall 30 and a top 32. Cap 14 may be molded from any thermoplastic material although it has been found that high-melt, low density polyethylene is among the most advantageous materials. A substantially annular radially inwardly extending retention bead 34 is provided adjacent the open end of cap 14. Bead 34 is interrupted by tear strips as will be explained below. Top portion 32 is provided with an inwardly extending hemispherical ball seal 36 for providing a positive seal to orifice 22 (as best seen in FIG. 4). Auxiliary molded beads 38 and 40 are provided to seat against rim 25 in order to resist any rocking tendency which cap 14 may have. A plurality of longitudinal radially inwardly extending compression ribs 42 are spaced around the interior of cylindrical side wall 30 in order to stabilize cap 14 on spout 12 and also to assist in the prevention of any rocking motion during removal of the cap (this facilitates tearing of thinned portions 56 and 58, discussed below). Cap 14 is provided with a pull-tab 50 which extends downwardly from side wall 30. As best seen in FIG. 4, tab 50 is generally aligned with side wall 30, lies adjacent the surface of spout 12 and is held slightly away from that surface by rib 52 in order to facilitate grasping of tab 50 by a user. The distal end of tab 50 may be squared off as shown in order to further facilitate grasping.

As best seen by reference to FIGS. 1, 2 and 3 tab 50 is an extension of a portion 54 of side wall 30. The only distinotion between portion 54 and the remainder of side wall 30 is that portion 54 is bounded on either side by tear strips or thinned portions 56 and 58 where the thickness of side wall 30 has been reduced to permit a user to tear tab 50 and portion 54 from the remainder of cap 14. By way of example, the wall thickness of the various portions of cap 14 may range from 0.020 inches to 0.040 inches while the thickness of portions 56 and 58 is in a range of 0.001 inch to 0.012 inches and the width of the portions ranges between 0.010 inches to 0.080 inches. In certain embodiments it may be desirable to have portions 56 and 58 extend into the top 32. The tearing of these portions may be enhanced by slits (best seen in FIG. 3*a*) extending partially into the top 32 as continuations of portions 56 and 58 to further decrease the resistance to tearing. In other embodiments it may be desirable to have portions 56 and 58 provided with even thinner portions 59 and 60 (which may even be apertures if desired) to facilitate tearing, as shown in FIG. 3*a*. Thinned portions 56 and 58 may for aesthetic reasons be formed with either a reduced surface or groove on the interior or exterior of side wall 30. If the groove is on the interior of side wall 30, the exterior of the cap will appear essentially uniform when in place on the spout since the thinness of the portions 56 and 58 will not be visible to an observer.

It is noted that, in the embodiment shown in FIG. 3*a* each portion 56 and 58 has a small lower section 56*a* and 58*a* that is thicker than the adjacent part of thinned portion 56 and 58, respectively. This requires the consumer to exert extra force to start the tear and this extra force facilitates easy tearing of the remainder of portions 56 and 58. Additionally, portions 56 and 58 have upper sections 56*b* and 58*b* that are thicker than adjacent parts of thinned portions 56 and 58, respectively. This reinforces the top 32 and facilitates the sealing function of the top.

The primary sealing point of the cap 14 is the hemispherical ball seal 36 molded to the inside of the top center of top 32. Ball seal 36 may be formed by either a depression 37 of the central part of top 32, as best seen in FIG. 2, or may be a thickened portion of top 32, as best seen in FIG. 4. It should be understood that the surface of top 32 may be slightly dimpled or depressed at area 37 in the event the depression type ball seal is used. Top 32 may be preloaded to provide a predetermined resistance to internal pressure, as will be understood below.

Referring now to FIG. 4, the assembly of cap 14 onto spout 12 will be best understood. It will be noted that the portion of spout end 20 above bead 24 has a slightly smaller radius than the portion of end 20 below bead 24; it may even be slightly inwardly tapered. This differentiation of sizes facilitates the assembly of cap 14 onto spout 12 during the manufacturing process. The external surface of side wall 30 is slightly tapered to be aligned with the taper of spout 12 for aesthetic purposes, as best seen in FIG. 4. It will be noted that when cap 14 is sealed on spout 12, bead 34 will be situated below bead 24 and bead 34 will be in contact with the distal side of bead 24. (The profiles of these beads are best seen in FIGS. 6 and 7). Simultaneously, ribs 42 will concentrically align cap 14 about end 20. Because of the resiliency inherent in the thermoplastic materials used to make the various parts, the two beads 24 and 34 are urged together and ball seal 36 is urged against orifice 22. Thus, unless excessive pressure exists in container 18, cap 14 provides an effective seal.

If, for some reason, excessive pressure is built up in container 18 (for example, if a user mixes the dye and developer in container 18 and replaces spout 12 prior to removing cap 14) upward pressure will be exerted on top 32, deforming it upwardly and permitting internal gas to escape around ball seal 36 and into the space between cap 14 and end 20 and through the gaps in annular bead 34 behind the thinned portions 56 and 58. As best seen by reference to FIG. 5, which shows a bottom plan view of cap 14 after tab 50 has been pulled to tear portions 56 and 58 and remove cap 14 from spout 12, tab 50 includes a molded bead 62. Bead 62 is a extension of bead 34. It will be understood that bead 34 is discontinued on the interior surface of portions 56 and 58 and it is these discontinuities which permit the venting of any excessive pressures. Alternatively, bead 24 may be discontinuous in one or more places.

As seen in FIG. 6, when a user grasps tab 50 and pulls it away from spout 12, thinned portions 56 (not shown) and 58 tear and bead 62 becomes disengaged from rib 24. Continued motion of tab 50 away from the spout causes cap 14 to be tilted and bead 34 to slide up past bead 24 so cap 14 may be taken off the spout. Because of the resiliency of the material, cap 14 may be replaced by merely pressing it on end 20. While this helps to limit spillage in the event the container 18 tips over, the seal is, after the tear strips are torn, no longer really effective.

Referring now to FIG. 7, an alternate embodiment of closure cap 14 is shown and is identical in all respects to the closure cap described in FIGS. 1 through 6 with the exception that closure cap 14*a* is provided with an axial load rim 68 in order to provide a recess 70 which protects the top of cap 14*a* either during shipment or use so that nothing may be placed on the top to limit upward motion of the top and thereby prevent upward flexing of the top of the cap during operation of the venting feature. FIG. 7 shows the cap 14 in an exaggerated tilted orientation to clearly show the path (arrows) by which internal pressures are vented.

It will be understood by those skilled in the art that numerous modifications and improvements may be made to the preferred embodiment of the invention disclosed herein without departing from the spirit and scope thereof.

What is claimed is:

1. A manually openable closure system for a container spout comprising:

a spout having a top surface with an orifice situated therein and an external annular first bead spaced a first predetermined distance from said surface;

a manually removable cap for closing the orifice of said spout comprising a cup shaped body having a top portion for covering said orifice, said body provided with an inwardly extending annular second bead spaced a second predetermined distance from said top portion and adapted to contact the distal surface of said first bead, the side wall of said body having an area bounded by a pair of longitudinal thinned portions spaced apart a predetermined arcuate distance;

a pull tab secured to said area of said side wall between said thinned portions and extending away from said top portion of said cap.

2. A manually openable closure system according to claim 1 wherein said pull tab is generally aligned with said side wall.

3. A closure system according to claim 1 wherein said spout and said cap are substantially cylindrical.

4. A closure system according to claim 1 further comprising a plurality of longitudinally aligned compression ribs spaced on the interior of said side wall.

5. A closure system according to claim 1 further comprising a ball seal on the interior of said top portion for closing the orifice.

6. A closure system according to claim 1 wherein said top portion is preloaded to seal said orifice and wherein the central portion thereof will be urged upwardly upon the occurrence of a predetermined pressure in said container and whereby a vent path will be formed between the internal surface of said cap and the external surface of said spout.

7. A closure system according to claim 1 wherein said annular second bead is discontinued along a predetermined portion thereof.

8. A closure system according to claim 1 wherein said annular first bead is discontinued along a predetermined portion thereof.

9. A closure system according to claim 1 wherein said pull tab is provided with a spacing rib to space the end of said pull tab from the adjacent surface of said spout.

10. A closure system according to claim 1 wherein said cap is provided with a concentric axial load rim on the exterior of said top portion.

* * * * *